United States Patent [19]

Field

[11] 4,453,531

[45] Jun. 12, 1984

[54] WOODBURNING STOVE

[76] Inventor: George D. Field, Field Dr., Pelham, N.H. 03076

[21] Appl. No.: 479,202

[22] Filed: Mar. 28, 1983

[51] Int. Cl.[3] ..... F24B 3/00

[52] U.S. Cl. ..... 126/61; 126/66; 126/67

[58] Field of Search ..... 126/58, 60, 61–66, 126/67, 70, 71, 80–83, 77, 76, 144, 146, 147, 151

[56] References Cited

U.S. PATENT DOCUMENTS

| | | | |
|---|---|---|---|
| 564,817 | 7/1896 | Barrier | 126/61 |
| 705,928 | 7/1902 | Heuermann | 126/60 |
| 4,186,717 | 2/1980 | King | 126/66 |
| 4,206,743 | 6/1980 | Niemela | 126/61 |
| 4,265,213 | 5/1981 | Gorsuch et al. | 126/66 |
| 4,397,292 | 8/1983 | Mitchell | 126/61 |

*Primary Examiner*—James C. Yeung
*Attorney, Agent, or Firm*—Hayes, Davis & Soloway

[57] ABSTRACT

A wood burning stove comprises top and bottom portions and unitary metal side panels having inwardly extending manifold sections running from the rear of the stove towards the front. Each said manifold section is formed by bending the metal to form a channel which lies wholly inwardly of the outer plane of each such panel, a unitary rear panel having an inwardly extending manifold section across the rear of the stove. The side manifolds extend from the front to rear of the stove, the end of each manifold being closed. There is an opening in the rear portion of each said side manifold and an opening in each end of said rear manifold, said openings in the side manifolds being aligned with the openings in the rear manifolds to permit passage of air from the rear manifold to the side manifold. There is a cover plate for each side manifold having hot air exit openings and a cover plate for the rear manifold having a cold air inlet opening with a blower mounted for forcing air into said rear manifold and out through the covers on said side manifolds.

6 Claims, 4 Drawing Figures

IN
OUT
54
16c
16b
16a
16
12

32
16
16a
16c
16b
12

16c
16b
32
16a
54a
18c
50
18b
14
22
34
18
18a
32
20
16
12

WOODBURNING STOVE

BACKGROUND OF THE INVENTION

The present invention is directed to improvements in woodburning stoves particularly the type having built in forced hot air heating ducts such as that sold under the tradename "Nashua". In such a stove the cold room air is forced by a blower into the rear of the stove through heating ducts on the sides and out through vents on the side of the stove. The present invention is directed to improved methods of manufacturing such stoves to provide greater structural integrity while providing long life and lower manufacturing costs.

SUMMARY OF THE INVENTION

In the present invention there are provided unitary metal side panels, each being made of a single sheet of metal having inwardly extending manifold sections which run from the rear of the stove toward the front of the stove. Each manifold section is preferably formed by bending the metal to create a channel which lies fully inwardly of the outer plane of the side panel. Thus the inside of the manifold is defined by a single sheet of metal free of welds and other connections. The rear panel is similarly formed with an inwardly protruding channel serving as a manifold section extending across the rear of the stove. This is also formed by bending the metal to form the channel which lies fully inwardly in the outer plane of the rear panel. The side manifolds are preferably substantially horizontal and extend from the front to the rear of the stove. Rear ends of the side manifolds are preferably closed by the rear panel and the front ends of the side manifolds are closed by the front panel thus forming a rigid sealed interior. Similarly the two ends of the rear manifold channel are closed by the butting against the side panels. In a preferred form of the invention, the rear ends of the side channels communicate with the two side ends of the rear channel to permit air to pass from the rear channel to the two center channels. In a preferred embodiment of the invention the side channels are higher than the rear channel and openings in the rear bottom surfaces thereof correspond with matching openings in the top end portions of the rear channel.

DETAILED DESCRIPTION OF THE INVENTION

Reference should now be made to the drawings taken in connection with accompanying text wherein.

Figure 1:
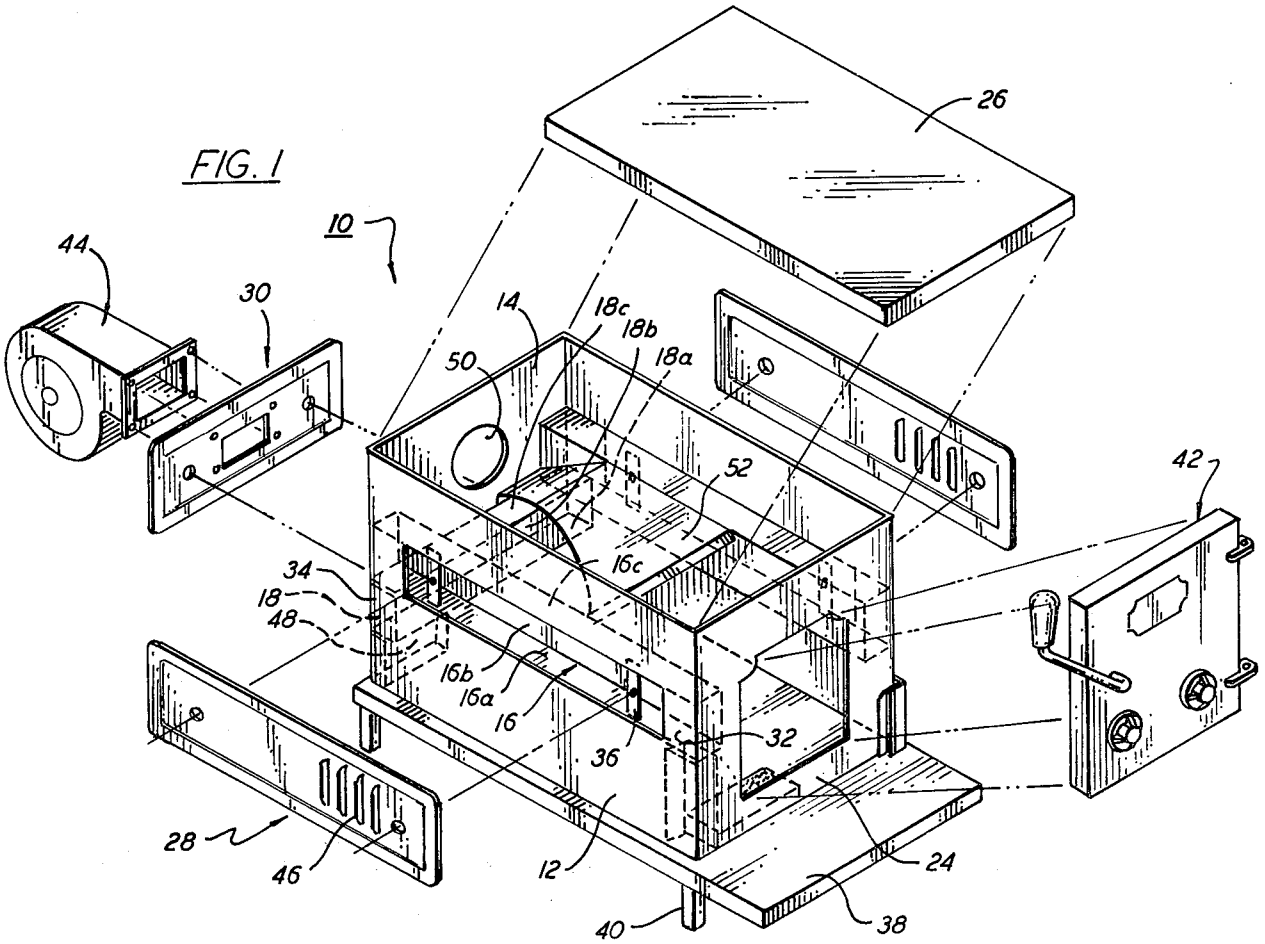
FIG. 1 is a diagrammatic exploded schematic view of the various elements making up the furnace of the present invention showing the relationships of the various parts.
Figures 2, 3, 4:
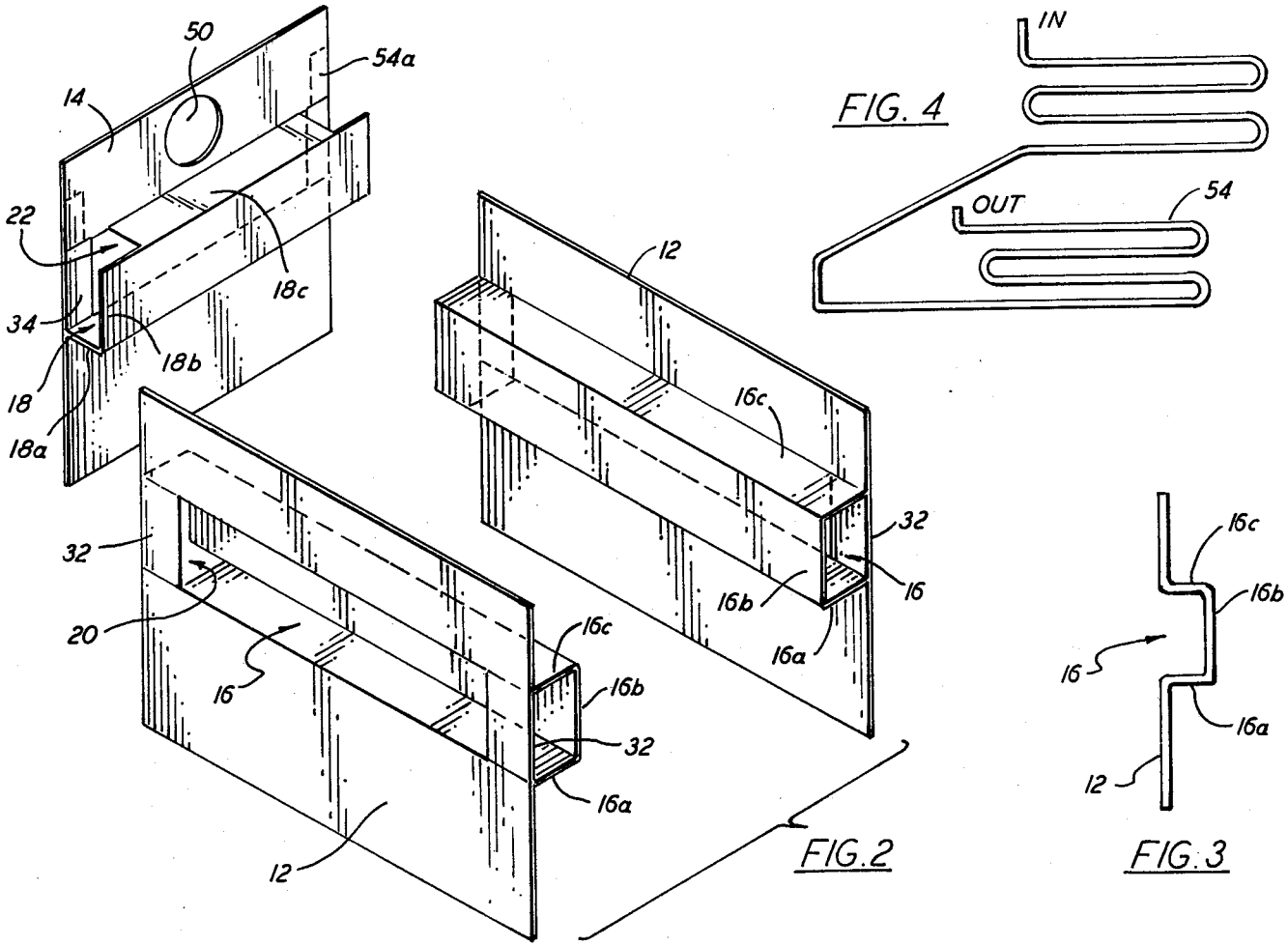
FIG. 2 is an enlarged exploded view showing the two side panels and the rear panel.
FIG. 3 is a cross-sectional view through a portion of the left hand panel.
FIG. 4 shows arrangements of a water heating coil which can be optionally inserted in the air heating channel so that the stove can additionally furnish domestic hot water.

Referring now to FIGS. 1 and 2, the stove is generally indicated at 10 as having two side panels 12 and a rear panel 14. Each side panel has a side manifold generally indicated at 16, this, in a preferred form, being shown as having a rectangular cross section. The bottom of the side manifold is indicated as 16*a*; the inner side of the side manifold is shown at 16*b*, and the top of the side manifold is shown at 16*c*. These are best seen by referring to FIGS. 2 and 3. The rear panel has a rear manifold 18 which similarly has a bottom 18*a*, an inner side 18*b* and a top side 18*c*, these being shown in greater detail in FIG. 2. As but seen in FIG. 2, the rear portion of the side manifold 16 has an opening 20 formed in the rear surface 16 by removing a portion of the rear of bottom surface 16*a* therefrom. This opening 20 is designed to overlap and match a similar opening 22 formed by removing a portion of the top wall 18*c* of the rear manifold 18, also shown in FIG. 2. Referring now again to FIG. 1, the stove is provided with a front panel 24 which, as can be seen, closes the front ends of the two channels 16 in the side manifolds. The rear panel 14 closes the rear ends of these two side channels 16. Similarly the side panels 12 overlap and close the open ends of the channel 18 constituting the rear manifold. A cover 26 which for ease in construction, is preferably a separate piece also closes the top of the furnace. Side manifold covers 28 cover most of the extent of each side manifold and a rear manifold 30 covers most of the rear manifold. However, fillets 32 at each end of the channel 16 on the side manifolds are provided, preferably by welding a piece after forming the channel, so that the side manifold cover does not have to extend completely to the end of the stove. Similar fillets 34 are provided in the rear panel to cover the outer ends of the channel 18. Side manifold brackets 36 are welded in place to permit attaching side manifold covers 28 by suitable bolts (not shown).

To complete the furnace, suitable base 38 is provided with feet 40, a front door 42 and a blower 44 adapted to blow air into the rear manifold cover. The air passes from the rear manifold through the side manifolds and out slots 46 in the side manifold covers. Fire brick 48 is provided between the base and the side and rear manifolds in the bottom portion of the furnace as well as covering the base 38. A chimney opening 50 is provided at the rear of the stove for connection to a suitable chimney and a baffle 52 is provided for proper draft through the furnace.

In FIG. 4, as mentioned previously, there is shown a water coil 54 which can be inserted in the side channels 16 to heat domestic hot water. In this case, the portions shown in dotted lines at 54*a* on the rear panel would be removed to permit insertion of the water coil and would be suitably sealed by means (not shown) to prevent escape of heating air therethrough.

While one preferred embodiment of the invention has been described above, numerous modifications thereof may be made without departing from the spirit of the invention. For example, the rear hot air manifold and the side manifolds may be in the same plane, in which case the rear ends of the side manifolds and the side ends of the rear manifold could be cut at 45° so that the two manifolds would precisely match each other to form a continuous air channel. Similarly while a rectangular form for the manifold has been shown, obviously the sides could be portions of curved surfaces such as semicircular.

Similarly, the two side panels 12 and the top panel 26 could be formed from one piece of metal. Important aspect of the invention is the one-piece construction of the side and rear panels to permit simple and inexpensive, rugged construction which needs only to be welded at the ends to provide an air tight, long-lasting stove.

What is claimed is:

1. A wood burning stove comprising top and bottom portions, a front panel, unitary metal side panels having inwardly extending manifold sections running from the rear of the stove towards the front, each said manifold section being formed by bending the metal to form a channel which lies wholly inwardly of the outer plane of each such panel, a unitary rear panel having an inwardly extending manifold section across the rear of the stove, the side manifolds being substantially horizontal and extending from the front to the rear of the stove, the rear end of said side manifold being closed by the rear panel, the front end of said side manifold being closed by the front panel, the rear manifold extending from one side of the stove to the other, the ends of said rear manifold being closed by said two side panels, an opening in the rear portion of each of said side manifold, an opening in each end of said rear manifold, said openings in the side manifolds being aligned with the openings in the rear manifolds to permit passage of air from the rear manifold to the side manifold, a cover plate for each side manifold having hot air exit openings, a cover plate for the rear manifold having a cold air inlet opening, a blower mounted for forcing air into said rear manifold and out through the covers on said side manifolds.

2. A wood burning stove comprising top and bottom portions, a front panel, unitary metal side panels having inwardly extending manifold sections running from the rear of the stove towards the front, each said manifold section being formed by bending the metal to form a channel which lies wholly inwardly of the outer panel of each such panel, a unitary rear panel having an inwardly extending manifold section across the rear of the stove, the side manifolds being substantially horizontal and extending from the front to the rear of the stove, the rear end of said side manifold being closed by the rear panel, the front end of said side manifold being closed by the front panel, the rear manifold extending from one side of the stove to the other, the ends of said rear manifold being closed by said two side panels, the upper surface of the rear manifold having openings of each end thereof, the lower surface of each side manifold having an opening at each rear end thereof, the upper surface of the rear manifold abutting and underlying the lower surfaces of the side manifolds with the openings in the rear manifold being aligned with the openings in the side manifolds, a cover plate for each side manifold having hot air exit openings, a cover plate for the rear manifold having a cold air inlet opening, a blower mounted for forcing air into said rear manifold and out through the covers on said side manifolds.

3. The stove of claim 2 wherein said side channels are rectangular in cross section.

4. The stove of claim 3 wherein said rear channel is rectangular in cross section.

5. A wood burning stove comprising top and bottom portions, a front panel, unitary metal side panels having inwardly extending manifold sections running from the rear of the stove towards the front, each said manifold section being formed by bending the metal to form a channel which lies wholly inwardly of the outer plane of each such panel, a unitary rear panel having an inwardly extending manifold section across the rear of the stove, the side manifolds extending from the front to rear of the stove, the ends of each manifold being closed by the front and rear panels respectively, an opening in the rear portion of each of said side manifold, an opening in each end of said rear manifold, said openings in the side manifolds being aligned with the openings in the rear manifolds to permit passage of air from the rear manifold to the side manifold, a cover plate for each side manifold having hot air exit openings, a cover plate for the rear manifold having a cold air inlet opening, a blower mounted for forcing air into said rear manifold and out through the covers on said side manifolds.

6. The stove of claim 5 wherein one of said manifolds contains a water heating coil.

* * * * *